United States Patent [19]

Sherman et al.

[11] Patent Number: 4,746,400

[45] Date of Patent: May 24, 1988

[54] METHOD OF TREATING CELLULOSIC CHIPS IN A VESSEL WITH A FALSE BOTTOM

[75] Inventors: Michael I. Sherman, Glens Falls, N.Y.; Johan C. F. C. Richter, St. Jean Cap Ferrat, France

[73] Assignee: Kamyr, Inc., Glens Falls, N.Y.

[21] Appl. No.: 492,035

[22] Filed: May 5, 1983

Related U.S. Application Data

[62] Division of Ser. No. 62,189, Jul. 30, 1979, Pat. No. 4,432,836.

[51] Int. Cl.[4] ..... D21C 3/24

[52] U.S. Cl. ..... 162/17; 162/52; 162/57

[58] Field of Search ..... 162/17, 19, 41, 52, 162/57

[56] References Cited

U.S. PATENT DOCUMENTS

| | | | |
|---|---|---|---|
| 3,802,956 | 4/1974 | Backlund | 162/19 |
| 4,028,171 | 6/1977 | Richter | 162/246 |
| 4,057,461 | 11/1977 | Richter | 162/246 |
| 4,104,113 | 8/1978 | Sherman et al. | 162/19 |

*Primary Examiner*—Peter Chin

*Attorney, Agent, or Firm*—Nixon & Vanderhye

[57] ABSTRACT

A method and apparatus for continuously treating cellulosic chips to prevent degredation of the chips as a result of mechanical action exerted on the chips by a scraper. A false bottom is provided in a vessel with the scraper mounted for rotation about a vertical axis just above the false bottom, a large central opening being provided in the false bottom. The scraper removes chips from the vessel through the false bottom opening to a bottom portion of the vessel. The temperature within the vessel at the area of the scraper is maintained at a first temperature that is low enough so that loss of strength of the chips material does not result from mechanical action exerted on the chips by the scraper. Liquid is introduced into the vessel bottom portion at a second temperature that is approximately at the cooking temperature for effecting digestion of the chips, and substantially higher than the first temperature. The heated liquid entrains chips and flushes them out an outlet from the vessel bottom, the chips subsequently being fed to the top of a digester in operative communication with the vessel.

7 Claims, 2 Drawing Sheets

Fig. 2
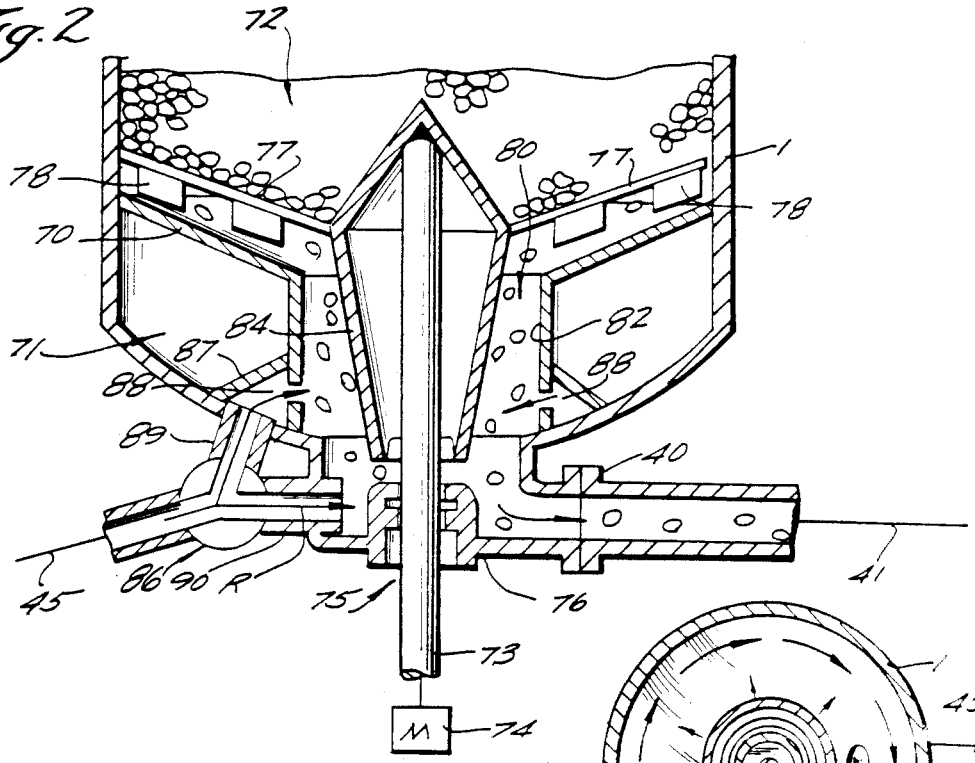
Fig. 4
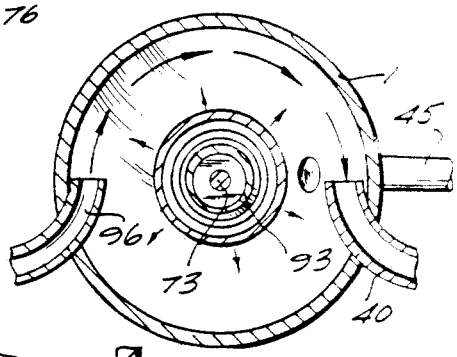
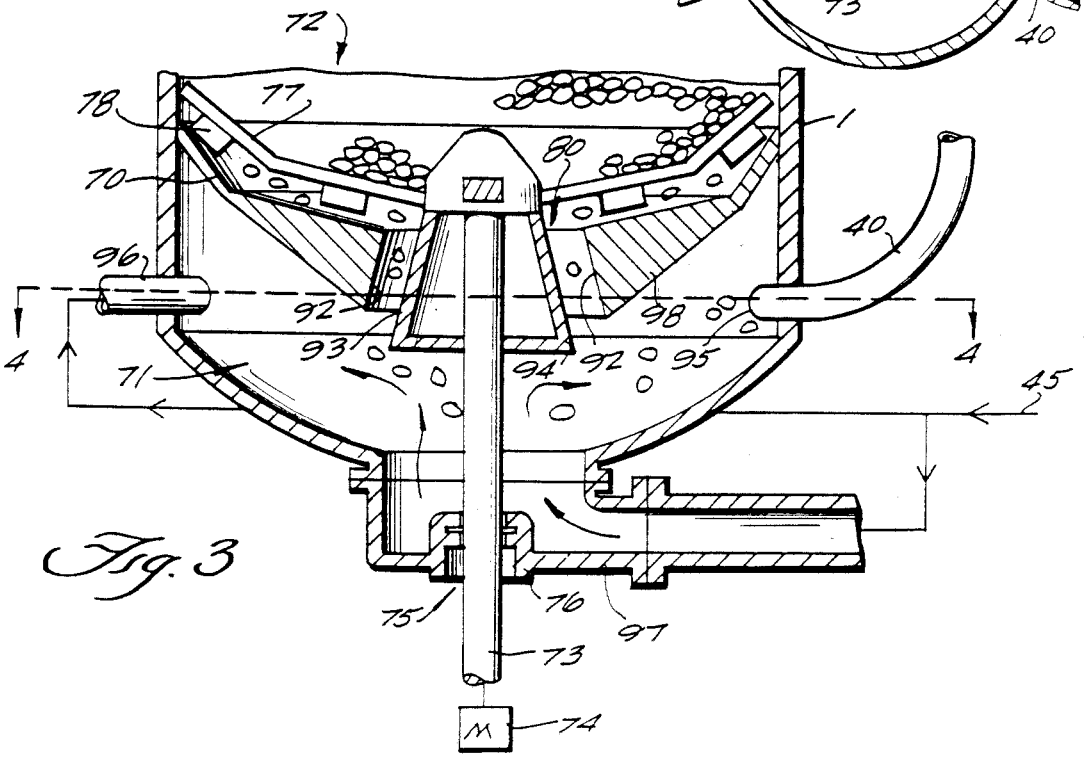
Fig. 3

METHOD OF TREATING CELLULOSIC CHIPS IN A VESSEL WITH A FALSE BOTTOM

This is a division of application Ser. No. 062,189, filed July 30, 1979, now U.S. Pat. No. 4,432,836.

BACKGROUND AND SUMMARY OF THE INVENTION

The invention relates to the construction of a cellulosic chips material treating vessel, and for a method of treating chips material or the like utilizing such a vessel, that overcomes practical problems heretofore encountered with certain prior art vessels.

Conventionally, upright cylindrical vessels for treating chips material or the like have a scraper disposed at the vessel bottom, and rotatable about a vertical axis, for effecting a uniform descending motion of the chips material over the entire cross-section of the vessel, and assuring proper movement of the chips material to the vessel outlet. Such scrapers are conventionally used in pulp digesters, impregnation vessels, and the like. It has been found according to the present invention that under some particular circumstances undesirable losses of pulp strength occur in treatment vessels. According to the present invention, it has been determined that the source of the pulp strength loss under some circumstances is as a result of the mechanical action exerted by the rotating scraper on the chips in the presence of hot alkali liquid substantially at, or near, cooking temperatures. Such a problem is most prevalent at the bottom of the first treatment vessel of a 2-vessel hydraulic digester system, such as disclosed in U.S. Pat. No. 4,104,113, the disclosure of which is hereby incorporated by reference herein. At the first vessel bottom portion in such a system hot liquid is introduced under pressure to flush (sluice) the chips material out of the vessel bottom to the top of the second treatment vessel.

According to the present invention the loss-of-pulp-strength problem encountered in conventional systems can be eliminated while still allowing the scraper to perform its desired functions of effecting uniform descent of the chips material and proper movement thereof to the vessel outlet. This is accomplished according to the present invention by isolating the scraper from the heated liquid flowing into the vessel bottom portion so that the temperature at the area of the scraper is at a first temperature which is low enough so that substantial loss of strength of the fiber material does not result from the mechanical action exerted thereon by the scraper. Such isolation is accomplished by providing a false bottom above the vessel bottom portion, with the scraper mounted for rotation just above the false bottom and a central opening being provided in the false bottom to allow chips to descend from the vessel to the vessel bottom portion containing the outlet. Treatment liquid is introduced into the vessel bottom portion below the false bottom to entrain the chips materials or the like therein and flush the entrained chips out the outlet. The introduced treatment liquid is at a second temperature substantially greater than the first temperature, which second temperature is great enough so that if mechanical action from the scraper were exerted upon chips entrained in liquid at the second temperature substantial loss of strength of the pulp would ensue. The first temperature is preferably maintained at about 230° to 300° F., and the second temperature is about 335° to 350° F. (approximately at cooking temperature for effecting digestion of the cellulosic fiber material).

It is the primary object of the present invention to provide an improved method and apparatus for the treatment of cellulosic fiber material (especially in a 2-vessel hydraulic digester system) whereby substantial loss of pulp strength as a result of mechanical action exerted on the material in the presence of hot alkali cooking liquor does not occur. This and other objects of the invention will become clear from an inpsection of the detailed description of the invention, and from the appended claims.

BRIEF DESCRIPTION OF THE DRAWINGS

FIG. 2 is a side view, partly in cross-section and partly in elevation, of the bottom of the first vessel of FIG. 1;

FIG. 3 is a side view, partly in cross-section and partly in elevation, of a modified form the first vessel bottom could take; and FIG. 4 is a sectional view taken substantially along lines 4—4 of FIG. 3.

DETAILED DESCRIPTION OF THE DRAWINGS

Figure 1:
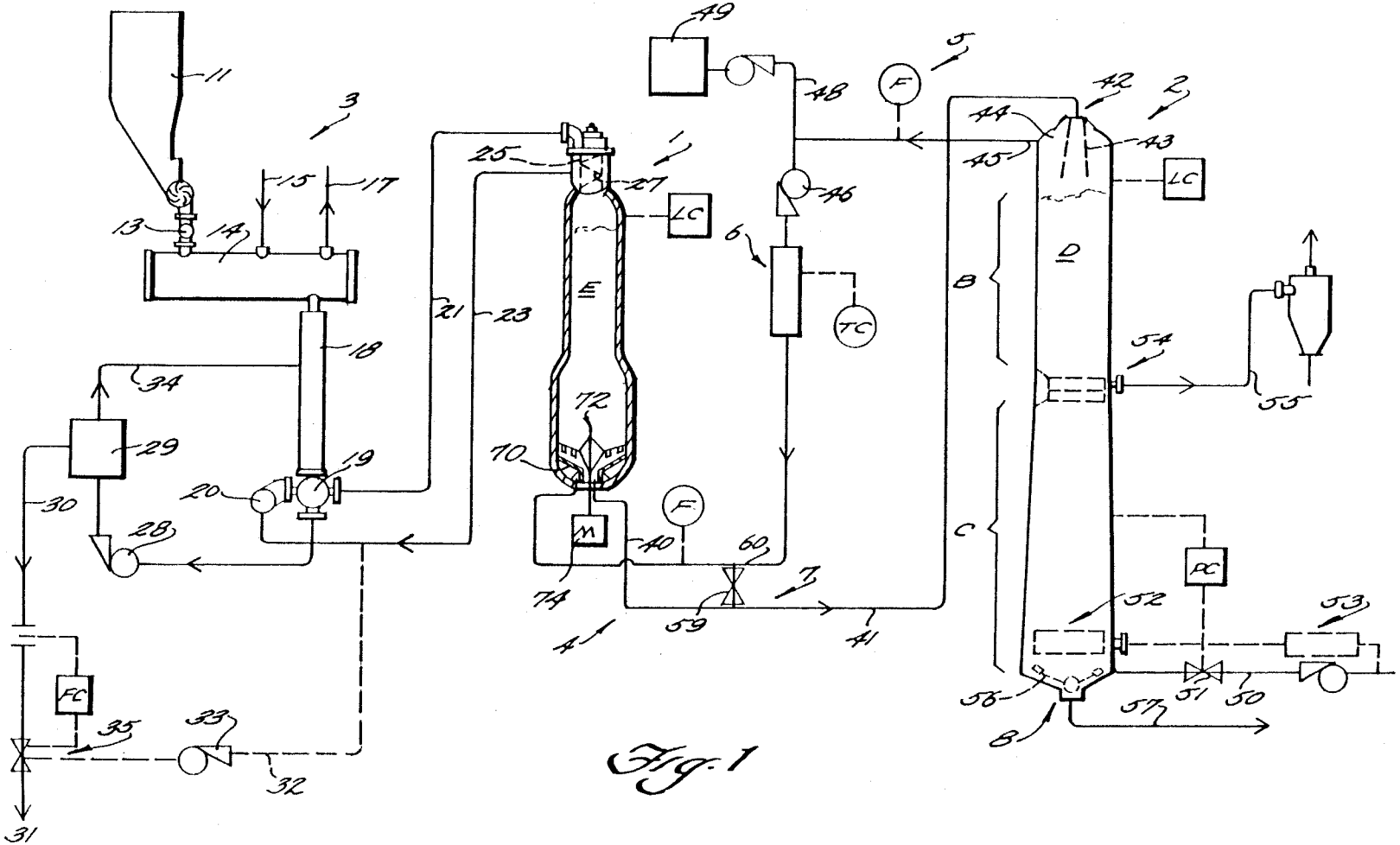
FIG. 1 is a schematic showing of an exemplary two-stage digestion system employing the teachings according to the present invention.

FIG. 1 illustrates a conventional 2-vessel hydraulic digestion system, but incorporating the teachings according to the present invention. Such a 2-vessel system is fully described in U.S. Pat. No. 4,104,113, the disclosure of which is hereby incorporated by reference herein. The present invention is most suited for such a 2-vessel system, however the method and apparatus according to the invention may also be utilized in any system where pulp degredation may occur at a vessel bottom as a result of a scraper exerting mechanical action on the fiber material at the vessel bottom in the presence of high temperature treatment liquor.

The apparatus in FIG. 1 includes apparatus for the digestion of cellulosic fiber material, generally including a first vertical treatment vessel 1 having top and bottom portion, a second vertical treatment vessel 2 separate from said first vessel and having top and bottom portions, and being substantially liquid filled, means 3 for feeding cellulosic fiber material entrained in treatment liquid to the top portion of the first vessel 1, means 4 for establishing a first flow path of cellulosic fiber material entrained in and impregnated with treatment liquid from the bottom portion of the first vessel 1 to the top portion of the second vessel 2, a column D of fiber material being established in the second vessel 2 below the level of liquid in the second vessel 2, means 5 for establishing a second flow path of liquid withdrawin from the top portion of the second vessel 1, means 6 for heating the liquid in the second flow path, means 7 for feeding a portion of the heated liquid flowing from the heating means in the second flow path into the first flow path (4) while feeding the rest of the heated liquid to the bottom portion of the first vessel 1, and means 8 for withdrawing digested fiber material from the bottom of the second vessel.

The means 3 for feeding cellulosic fiber material entrained in treatment liquid to the top portion of the first vessel 1, preferably includes a chips bin 11 containing cellulosic fiber material therein (the cellulosic fiber material may be wood chips, straw, bagasse, reed, or other cellulosic plant materials), rotary low pressure valve 13, a steaming vessel 14, a conduit 15 for supplying low pressure steam (e.g. 1 atmosphere over pressure) to the vessel 14, and a conduit 17 through which air driven off during steaming may flow. From the steaming vessel 14, the cellulosic fiber material leads to a conduit 18, treatment (digesting) liquid being supplied to the fiber material in conduit 18. The fiber material then flows into conventional high pressure transfer valve 19 having a rotor with pockets therein turning in the stationary casing to provide boosting of the pressure of the flow in which the chips are entrained. Circulating liquid pressurized by the pump 20 entrains the fiber material in transfer valve 19, and the fiber material entrained in treatment liquid flows through conduit 21 to the top portion of first (impregnation) treatment vessel 1, a line 23 leading from the top of the treatment vessel 1 back to the pump 20. A strainer girdle 25 is provided in the top of the vessel 1, to provide for withdrawal of liquid from the top portion of the vessel 1 and recirculation thereof through line 23. A feeding screw 27 disposed in the top portion of vessel 1 feeds the fiber material into vessel 1 to establish a fiber column E (which may be monitored by a level control). A pump 28 is disposed in the low pressure line leading from transfer valve 19 back through straining means 29 to line 34 which feeds liquid to the conduit 18. A portion of the liquid flowing in this loop is removed by the straining means 29 through conduit 30, this liquid either passing to recovery (31) or passing into line 32 under the influence of pump 33, and ultimately back into line 23. A flow control valve 35 may be provided in line 30.

Impregnation takes place in first vertical treatment vessel 1. The impregnated cellulosic fiber material passes into means 4, and then ultimately to second treatment vessel 2. The means 4 for establishing a first flow path includes an outlet 40 disposed at the bottom of the vessel 1, a conduit 41 extending from the outlet 40 to the top of second treatment vessel 2, and means 42 at the top of the second vessel 2 for introducing the fiber material into the vessel 2 and establishing a column D in the vessel 2. The means 42 can include any suitable feeding means, however, it is preferred that it includes an inverted funnel-shaped tube 43, the column of fiber material in the second vessel being established below the bottom of the tube 43, so that screenless withdrawal of treatment liquid from the top area 44 of vessel 2 above the column D may be provided.

The means 5 for establishing a second flow path may include conventional screens (not shown) for withdrawing liquid therethrough at the top of the vessel 2, however, it is preferred that screenless withdrawal be provided by providing the withdrawal conduit 45 at a portion of the vessel 2 in chamber 44 above the column D of fiber in the vessel 2 (as more fully described in the above-mentioned copending applications). A pump 46 disposed in second flow path 5 provides suction for the withdrawal of liquid, and conduit 45 passes through heating means 6 to an inlet 47 at the bottom of impregnation vessel 1. The liquid that flows through inlet 47 into the bottom of first treatment vessel 1 is heated, being at approximately cooking temperature (i.e. about 335° to 350° F.). The means 5 establishing a second flow path also preferably includes a source 49 of fresh treatment (digesting) liquid and a conduit 48 leading from the source 49 to the second flow path conduit 45 upstream of the pump 46 in the second flow path. (Alternatively, the source 49 and line 48 may be connected to line 32 instead of line 45).

The second treatment vessel 2, which comprises a digesting and washing treatment vessel, includes a digesting (cooking) zone B and a washing zone C. The digested fiber material is washed in countercurrent in the vessel 2 by means of washing liquid supplied by the conduit 50 and pumped into the lower end of the vessel 2 in a quantity controlled so as to maintain the vessel 2 filled with liquid. The amount of liquid flowing through line 50 also is controlled by pressure responsive valve 51, the position of the valve 51 being responsive to the pressure within the washing zone C. Washing liquid may be withdrawn by conventional strainer girdle 52 and indirectly heated by steam in heater 53 and then returned to the inlet line 50. Heated washing liquid is driven in countercurrent up through the slowly descending chips column in vessel 2 and displaces its contents of spent digesting liquor which departs through the conventional strainer girdle 54 and then is passed through line 55 to ultimate recovery. A conventional rotating scraper 56 is provided at the bottom of the vessel 2 which in combination with outlet line 57 forms the means 8 for withdrawing digested fiber material from the bottom of the second vessel 2.

The heating means 6 in second flow path 5 may include any conventional direct or indirect heating means, the temperature of the heating means 6 being controlled to provide digesting liquor of a given temperature in the first and second flow paths.

The means 7 for feeding the portion of the heated liquid flowing in the second flow path 5 into the first flow path 4 while feeding the rest of the heated liquid to the inlet 47 in the bottom of first vessel 1, preferably comprises an adjustable valve 59 disposed in a conduit 60 extending between conduits 45 and 41. The position of the valve 59 may be adjusted by manual means, or may be responsive to the flow in lines 45 and 41.

According to the method of digesting cellulosic fiber material utilizing the FIG. 1 apparatus, cellulosic fiber material entrained in treatment liquid is fed into a top portion of the first vessel 1—from chips bin 11, presteaming vessel 14, high pressure transfer valve 19, and feed screw 27—to establish a column E of fiber material in the vessel 1. Impregnation of the fiber material takes place in the vessel 1, and a first flow path 4 is established for cellulosic fiber material entrained in and impregnated with treatment liquid from the outlet 40 in the bottom portion of the vessel 1 to top 42 of vessel 2, liquid substantially filling the second vessel 2. A column D of fiber material is established in the second vessel 2 below the level of liquid in the second vessel 2, and liquid is withdrawn from the top portion (chamber 44) of the second vessel 2. A second flow path 5 is established for the liquid withdrawn from the second vessel back toward a bottom portion of the first vessel 1, and heating of the liquid by means 6 takes place during transport of the liquid in the second flow path 5. A portion of the heated liquid flowing in second flow path 5 is fed—through valve 59 in conduit 60—to conduit 41 of first flow path 4, while the rest of the heated liquid is fed into inlet 47 in the bottom of the first vessel 1. Digested fiber material is withdrawn through line 57 from the bottom of treatment vessel 2, and washing may take place in treatment vessel 2 (in zone C) if washing liquid is introduced through conduit 50 to flow countercurrently to the fiber material in the vessel 2.

The 2-vessel system described above also comprises a scraper rotatable about a vertical axis disposed at the bottom of the first vessel 1. Everything described so far is conventional. According to the present invention, means are provided for isolating the conventional scraper disposed at the vessel 1 bottom from the heated liquid flowing in line 45 to the bottom of the vessel 1 so that the tmperature within the vessel 1 at the area of the scraper is at a first temperature which is low enough so that substantial loss of strength of fiber material does not result from mechanical action exerted on the fiber material by the scraper, but so that the scraper ensures uniform feeding of fiber material into the bottom portion of the first vessel.

Such isolating means according to the present invention comprise a false bottom 70 disposed in the vessel 1 above the bottom portion 71 thereof. A conventional scraper 72 is provided with means for mounting the scraper 72 just above the false bottom 70 for rotation about a vertical axis, such mounting means including a vertical shaft 73 which can be driven by a conventional variable speed motor 74 or the like, the shaft extending up through bushings 75 in the lowest point 76 at the bottom of the vessel 1. The scraper 72 comprises a plurality of scraper arms 77 having conventional blades 78 thereon.

Means are provided defining a relatively large opening 80 in the false bottom 70, the opening 80 provided for the passage of chips material or the like under the influence of the scraper 72 into the vessel bottom portion 71. The scraper 72 ensures uniform descent of the chips material from the vessel 1 into the bottom portion 71, and proper movement thereof to the outlet 40. Heated treatment liquid is introduced under pressure from the line 45 and accessory introducing means into the vessel bottom portion 71 to entrain chips passing into the bottom portion 71 through the opening 80 to flush them out the outlet 40 into the flow path 41. The temperature of the liquid introduced into the bottom portion 71 is approximately at cooking temperature for effecting digestion of the chips, i.e. about 335° to 350° F., which is high enough so that if mechanical action from the scraper were exerted upon chips entrained in liquid at that temperature substantially loss of strength of the pulp would ensue. By providing isolation of the chips at the area of the scraper from this heated liquid in bottom portion 71 by the false bottom 70 and related structures, and by properly controlling the temperature of the chips and entrained liquor introduced into the vessel 1, the temperature at the area of the scraper 72 is maintained at about 230° to 300° F., which is low enough so that substantial loss of strength of the pulp as a result of mechanical action exerted thereon by the scraper 72 does not occur.

The various structures for defining the bottom portion 71 and for the flow of chips through the opening 80 to the outlet 40, and for introducing the heated treatment liquor into the vessel bottom 71, may differ significantly. Such structures are significantly different in the FIG. 2 and the FIGS. 3 and 4 embodiments.

In the FIG. 2 embodiment, a cylindrical wall member 82 is provided which defines a flow path through the opening 80 that is circular in cross-section and concentric with the vessel 1. The shaft 73 extends through the flow path defined by the member 82, concentric therewith, and means are provided for defining the flow paths so that it gradually increases in cross-section from the opening 80 to the outlet 40. Such means include an inverted truncated cone shroud 84 surrounding the shafts 73 and having its largest diameter portion just above the false bottom 70 at the opening 80, and having its smallest diameter portion just above the outlet 40. Thus, the flow path through the opening 80 to the outlet 40 is generally annular.

In the FIG. 2 embodiment, the outlet 40 provides a radially outward path from the lowest point 76 of the vessel bottom. The means for introducing liquid under pressure into the bottom portion 71, in addition to the line 45, comprises means for introducing liquid radially into the bottom portion 71 substantially coincidental with the outlet path (see arrow R in FIG. 2) and means for introducing liquid at a plurality of points around the circumference of the cylindrical member 82 (see arrows S in FIG. 2). Such liquid introduction means are defined by the Y-connection 86 of the line 45, a conical header 87 surrounding the flow path defined by the cylindrical member 82, with a plurality of openings 88 being disposed around the circumference of the member 82 in communication with the interior of the header 87. One branch 89 of the Y leads to the conical header 87, and the other branch 90 of the Y extends substantially radially and coincident with the flow path through the outlet 40. The area 9I between bottom 70, vessel 1, header 87, and member 82 is liquid-filled to equalize pressure.

In the FIG. 2 embodiment, liquid flowing through the openings 88 entrains the chips flowing through the cylindrical member 82 therein, and the combination of the increase in cross-sectional area of the flow path defined by the member 82 and shroud 84, and the directional flow of the introduced liquid in path R, causes the chips entrained with liquor to be flushed (sluiced) out of the outlet 40 into the conduit 41.

In the embodiment of FIGS. 3 and 4, the means defining the flow path from the opening 80 toward the outlet 40 includes a conical member 92 extending downwardly from the false bottom opening 80, and flaring outwardly. The conical member 92 may be formed as an enlarged termination of the false bottom 70 at the opening 80. The flow path defining means further comprises a truncated conical shroud 93, including a closed bottom portion 94. The shroud 93 surrounds the shaft 73 and has the smallest diameter portion thereof disposed substantially at the top of the member 92, and has the largest diameter portion thereof disposed just below the bottom of the member 92.

In the FIGS. 3 and 4 embodiment, the outlet 40 is arranged so that liquid with entrained chips must flow tangentially in order to exit the vessel 1. This is accomplished, as seen in FIG. 4, by providing an inward extension 95 of the outlet pipe 40 that is disposed tangentially. The outlet 95 is disposed vertically above the bottom of the conical member 92.

In the FIGS. 3 and 4 embodiment, the means for introducing liquid into the vessel bottom 71 comprises a first branch 96 of line 45 for introducing liquid tangentially at a level substantially vertically even with the outlet 95. The tangential flow from inlet branch 96 is directed so that it directs chips entrained in liquor caught up therein into the opening in the outlet 95, as indicated by the curved arrows in FIG. 4. The liquid introducing means in this embodiment further comprises a second branch 97 of the line 45 for introducing liquid upwardly from the vessel bottom lowest point 76 so that it is deflected radially outwardly by the bottom 94 of the conical shroud 93, as indicated by the radially extending arrows in FIG. 4.

In the FIGS. 3 and 4 embodiment of the invention, the chips passing through the opening 80 are entrained by the upwardly and radially flowing liquid from the inlet 97; and the shape of the flow path defined by the conical member 92 (including the bottom portions 98 thereof), the relative placement of the outlet 95 and inlet 96, and the directional nature of the liquid introduced in the inlet 96, causes the chips and entrained liquid to be directed to the outlet 95 and pass out therethrough.

Thus, it will be seen that according to the present invention a method and apparatus have been provided for isolating a scraper from heated liquid flowing into a vessel bottom portion so that the temperature within the vessel at the area of the scraper is low enough so that substantial loss of strength of the pulp does not result from mechanical action exerted thereon by the scraper, yet the scraper is positioned so as to ensure uniform feeding of fiber material into the bottom portion of the vessel, and proper movement of the pulp to the outlet to be sluiced to another treatment vessel.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent devices, systems, and methods.

What is claimed is:

1. A method of continuously treating cellulosic chips material or the like, utilizing an upright cylindrical vessel having a bottom, a false bottom disposed above the bottom, a scraper disposed above the false bottom, an outlet from the bottom, and an inlet at the top the outlet arranged so that liquid with entrained chips material or the like must flow tangentially relative to the vessel wall in order to exit the vessel; said method comprising the steps of:

(a) feeding chips material or the like into the vessel inlet;

(b) treating the chips material or the like in the vessel with a treating liquid;

(c) maintaining the temperature within the vessel at the area of the scraper at a first temperature which is low enough so that substantial loss of strength of the chips material or the like does not result from mechanical action exerted on the chips material or the like by the scraper;

(d) effecting feeding of chips material or the like through an opening in the false bottom into the vessel bottom; and (e) introducing liquid at a second temperature into the vessel bottom, below the false bottom, to entrain chips material or the like therein and flush the entrained chips material or the like out the outlet, said second temperature being substantially greater than said first temperature, by introducing liquid into the vessel bottom both tangentially at about the same vertical level as the outlet, and upwardly from the lowest point of the bottom.

2. A method as recited in claim 1 wherein said second temperature is great enough so that if mechanical action from the scraper where exerted upon chips material or the like entrained in liquid at said second temperature substantial loss of strength of said chips material or the like would ensue.

3. A method as recited in claim 1 wherein said second temperature is approximately at cooking temperature for effecting digestion of the chips material or the like.

4. A method as recited in claim 1 wherein said first temperature is about 230° to 300° F., and wherein said second temperature is about 335° to 350° F.

5. A method as recited in claim 1 comprising the further step of feeding chips material or the like entrained in liquid from the outlet to the top of a digester, separating liquid from chips material or the like at the digester top and recirculating it through a heater for use in practicing step (e).

6. A method as recited in claim 1 wherein the treatment liquid is a digesting liquor.

7. A method of digesting cellulosic fiber material utilizing a first vessel and a separate second vessel, said first vessel having a scraper rotatable about a vertical axis disposed just above a bottom portion thereof, and an outlet from the first vessel providing a portion of said first flow path being arranged so that liquid with entrained fiber material must flow tangentially relative to the first vessel in order to exit that vessel; said method comprising the steps of continuously: feeding cellulosic fiber material entrained in treatment liquid into a top portion of the first vessel; establishing a first flow path of cellulosic fiber material entrained in and impregnated with treatment liquid from a bottom portion of the first vessel to a top portion of the second vessel, liquid substantially filling the second vessel, the treatment liquid being approximately at cooking temperature for effecting digestion of the fiber materials; establishing a column of fiber material in the second vessel below the level of liquid in the second vessel; withdrawing liquid from a top portion of the second vessel; establishing a second flow path of the liquid withdrawn from the second vessel back toward to a bottom portion of the first vessel; heating the liquid during transporting said second flow path; feeding a portion of the heated liquid flowing in said second flow path into said first flow path while feeding the rest of the heated liquid to the bottom portion of the first vessel; and withdrawing digested fiber material from the bottom of the second vessel; and maintaining the temperature within the first vessel at the area of the scraper at a first temperature which is low enough so that substantial loss of strength of the fiber material does not result from mechanical action exerted on the fiber material by the scraper, while the scraper effectively ensures uniform feeding of fiber material into the bottom portion of the first vessel wherein it is entrained in heated liquid and passes directly into said first flow path, by disposing a false bottom in the first vessel, above the bottom portion of the first vessel, with the scraper disposed just above the false bottom, with an opening provided in the false bottom to the bottom portion of the first vessel; and wherein the step of establishing said first flow path is accomplished by introducing liquid approximately at cooking temperature into the first vessel bottom both tangentially at about the same vertical level as the outlet, and upwardly from the lowest point of the first vessel bottom.

* * * * *